US006575806B1

(12) United States Patent
Nelson et al.

(10) Patent No.: US 6,575,806 B1
(45) Date of Patent: Jun. 10, 2003

(54) BALLOON LOCKING CUP AND SECURING SYSTEM

(75) Inventors: David C. Nelson, Akron, OH (US); John J. Andrisin, Cuyahoga Falls, OH (US); Martin A. Meluch, Newton Falls, OH (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 0 days.

(21) Appl. No.: 10/098,223

(22) Filed: Mar. 13, 2002

Related U.S. Application Data

(62) Division of application No. 09/519,623, filed on Mar. 6, 2000, now Pat. No. 6,430,804.

(51) Int. Cl.[7] ..... A63H 3/06
(52) U.S. Cl. ..... 446/222; 446/220
(58) Field of Search ..... 446/220, 221, 446/222, 223, 224, 225, 226

(56) References Cited

U.S. PATENT DOCUMENTS 2,882,645 A * 4/1959 Stivers ..... 446/220
4,715,841 A * 12/1987 Nelson et al. ..... 446/222
4,798,554 A * 1/1989 Nelson et al. ..... 446/222
4,837,059 A * 6/1989 Milne ..... 446/222
4,895,545 A * 1/1990 Nelson ..... 446/220
5,024,011 A * 6/1991 Collins ..... 446/220
5,444,607 A * 8/1995 Dreyfuss ..... 446/220
5,588,897 A * 12/1996 Valentino ..... 446/222
5,944,576 A * 8/1999 Nelson et al. ..... 446/220
6,176,758 B1 * 1/2001 Wu ..... 446/220
6,375,534 B1 * 4/2002 Burns ..... 446/220

* cited by examiner

*Primary Examiner*—David P. Bryant
(74) *Attorney, Agent, or Firm*—Renner, Kenner, Greive, Bobak, Taylor & Weber

(57) ABSTRACT

A balloon locking cup and securing system includes a cup having a latch interposed between a funnel shaped cup portion and a tube extension. The balloon cup is placed over a reciprocating needle hook rod in a securing system. The tail of the balloon is received by a hook at the end of the hook rod and a first pneumatic cylinder is actuated to pull the needle hook rod in such a manner as to pull the balloon into nesting engagement with the balloon cup. At the end of travel of the first pneumatic cylinder, a second pneumatic cylinder is automatically actuated, causing a knife blade to separate the end of the balloon tail just beneath the tubular member of the balloon cup assembly. The drawing of the balloon into the cup assembly actuates the latch which engages the balloon tail near the neck of the balloon and secures the balloon in the cup assembly.

6 Claims, 4 Drawing Sheets

BALLOON LOCKING CUP AND SECURING SYSTEM

This application is a division of Ser. No. 09/519,623, filed Mar. 6, 2000, now U.S. Pat. No. 6,430,804.

TECHNICAL FIELD

The invention herein resides in the art of balloon accessories and, more particularly, to balloon cups for receiving and maintaining balloons at the end of a stick. More particularly, the invention relates to a device for securedly engaging a balloon in a cup prior to securement to the stick. Specifically, the invention relates to a locking cup for employment with a device for rapidly and effectively securing a balloon into a balloon cup.

BACKGROUND ART

The use of balloons for various functions and purposes has become extremely popular. Often, the balloon is secured to the end of a stick. In order to keep the balloon in a desired and secured orientation with respect to the stick, the balloon is typically received in a cup. In the past, the tail of the balloon has been manually threaded in a hole in the cup sidewall, then wound in slots provided in the sides of the cup to securedly maintain the balloon in seated engagement in the cup. Ultimately, the cup was then secured to a stick. The prior technique of hand winding the tail of a balloon in slots within the balloon cup is not only time consuming and ineffective, but typically results in balloons that are not securely seated within the cup, but which are often canted or askew.

There is a need in the art for a device that may be used in association with a balloon cup for rapidly, effectively, uniformly and repeatedly securing a balloon in a balloon cup.

SUMMARY OF THE INVENTION

In light of the foregoing, it is a first aspect of the instant invention to provide a balloon locking cup and securing system wherein a locking cup securedly and nestingly receives a balloon.

Another aspect of the invention is the provision of a balloon locking cup and securing system which allows balloons to be nestingly secured in a balloon cup in a rapid, uniform and effective manner.

Still a further aspect of the invention is the provision of a balloon locking cup and securing system in which the locking of the balloon within the cup is automatic effected.

Yet a further aspect of the invention is the provision of a balloon locking cup and securing system that effects the trimming of the balloon tail to a predetermined length.

Still a further aspect of the invention is a balloon locking cup and securing system which allows for the rapid, effective and economical securing of a balloon within a cup, ready for application to a stick.

Yet an additional aspect of the invention is the provision of a balloon locking cup and securing system which is reliable in operation and conducive to implementation with state of the art apparatus and techniques.

The foregoing and other aspects of the invention which will become apparent herein are achieved by a balloon cup assembly for receiving and maintaining a balloon, comprising: a tube; a funnel received at a first end of said tube, said funnel and said tube defining a continuous passage; and a latch positioned for selective interposition within said passage.

Other aspects of the invention are attained by a balloon cup securing system, comprising: a housing having first and second bores therein; a rod passing through said first bore, said rod configured to engage a tail of a balloon; and a blade passing through said second bore.

Yet other aspects of the invention which will become apparent herein are attained by a method of securing a balloon to a balloon cup, comprising: passing a hook rod through a balloon cup; engaging a balloon tail with a hook of said hook rod; pulling said hook rod through a bore and nesting the balloon in the balloon cup; and cutting said tail with a blade.

DESCRIPTION OF THE DRAWINGS

For a complete understanding of the objects, techniques and structures of the invention reference should be made to the following detailed description and accompanying drawings wherein.

BEST MODE FOR CARRYING OUT THE INVENTION

Figure 1:
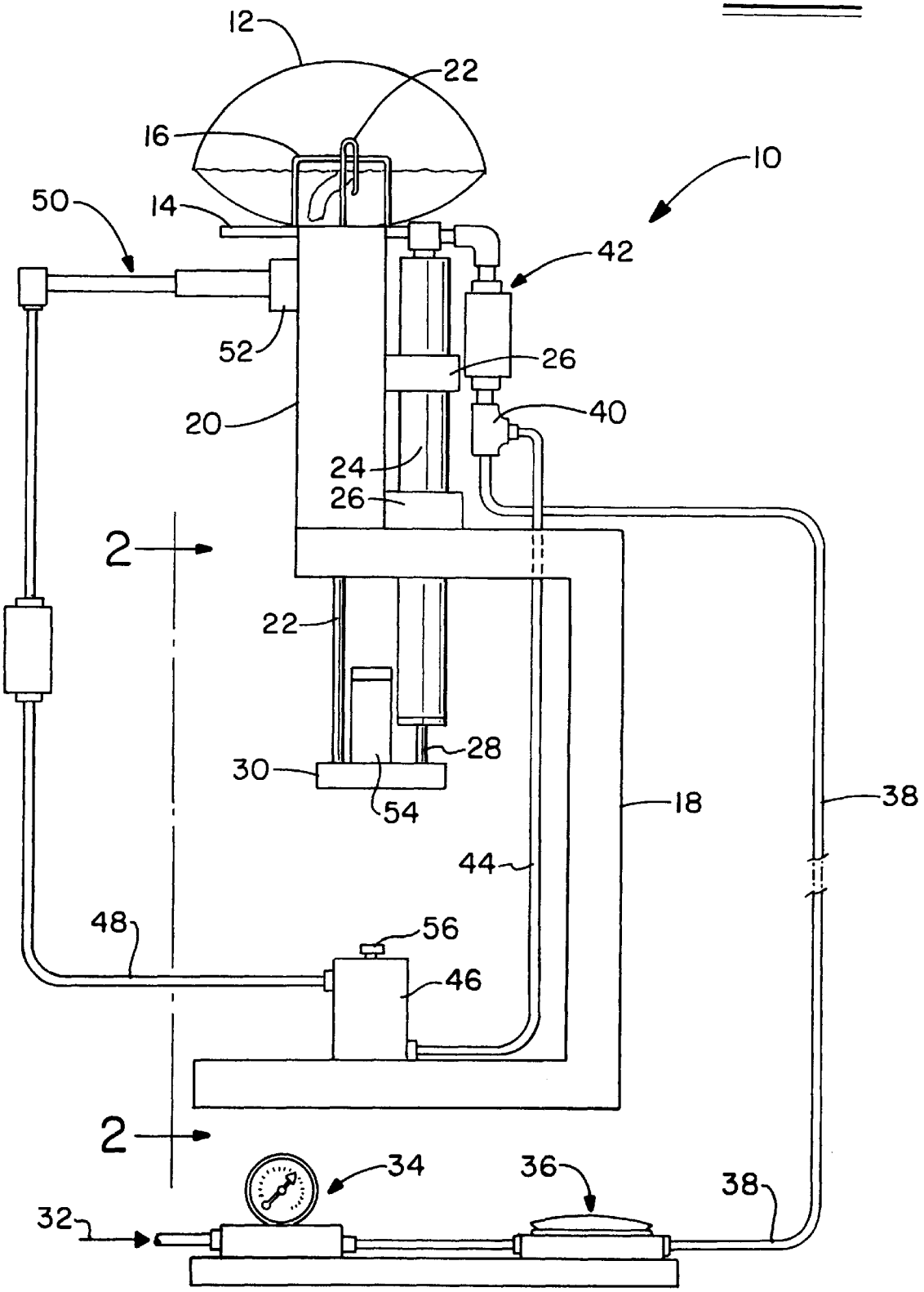
FIG. 1 is a side elevational view of a balloon cup securing system according to the invention.

Referring now to the drawings and more particularly to FIG. 1, it can seen that a balloon cup securing system made in accordance with the invention is designated generally by the numeral 10. The system 10 is configured to receive a balloon 12 which, in accordance with the preferred embodiment of the invention, would typically be a "foil" balloon filled with air, helium or the like. The balloon 12 is received upon a supporting platform 14 and abuts an end bracket 16. As will be appreciated later herein, the platform 14 and end bracket 16 serve to properly position the balloon 12 within the system 10 for the cup securing process.

A support frame 18 which, in this embodiment, is generally C-shaped receives a housing 20 which reciprocatingly receives a needle hook rod 22 therein and passing therethrough. A pneumatic cylinder or actuator 24 is attached to the housing 20 and/or to the support frame 18 by appropriate collars 26. A piston rod 28 extends from and is reciprocatingly received by the pneumatic cylinder 24 and is connected at an end thereof to a base plate 30. As shown, the base plate 30 also securedly receives the needle hook rod 22 as by threaded engagement or the like. As a consequence, as pneumatic actuator 24 reciprocatingly drives the plate 30 as by extending and returning the piston rod 28, the needle hook rod 22 is caused to correspondingly reciprocate within the housing 20. Those skilled in the art will appreciate that the pneumatic cylinder or actuator 24 may be of any of various types, including the type in which the piston rod 18 is driven from the cylinder 24 and returned by spring action and/or by exhausting the cylinder.

A source of compressed air 32 passes through a pressure regulator 34 and to a foot pedal valve 36 as illustrated in FIG. 1, the foot pedal valve 36 selectively passes the air pressure set by the regulator 34 through a conduit 38 and to a T-connection 40. One output of the T-connection 40 is the interconnection of a union and an elbow 42 which then passes the compressed air upon actuation of the foot pedal valve 36 to the pneumatic cylinder or actuator 24. The output of the other side of the T-connection 40 passes through a conduit 44 and through a limit switch valve 46 to a conduit 48 where it is introduced to a second pneumatic cylinder or actuator 50. As illustrated, the pneumatic actuator 50 is mounted to the housing 20 by an appropriate collar 52, or the like.

It will be appreciated that actuation of the foot pedal 36 causes air pressure to be introduced on the input side of the limit switch valve 46 which, upon opening, passes the air pressure through the conduit 48 and to the pneumatic actuator 50. As will be discussed later herein, a blade is attached to the pneumatic actuator 50 for trimming the tail of the balloon 12 immediately following its securement within a balloon cup. Again, the pneumatic actuator 50 may of any of various types, being air driven into actuation and having either a spring return or exhaust return.

Figure 2:
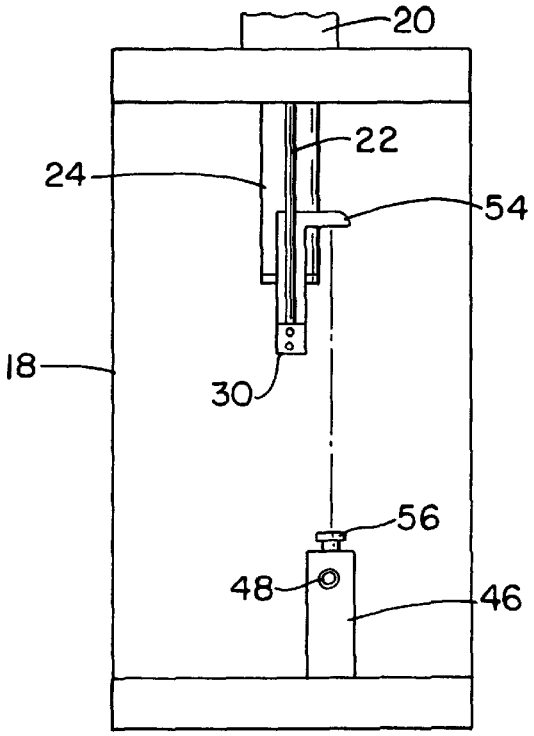
FIG. 2 is a view of the system of FIG. 1 taken along the line 2—2.
Figure 3:
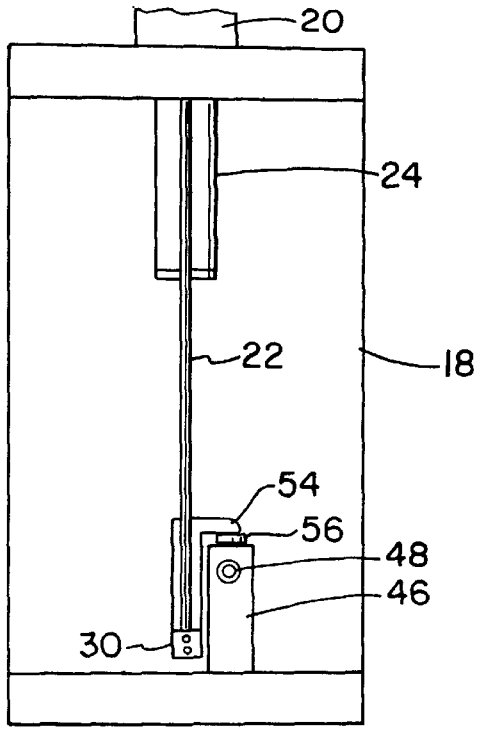
FIG. 3 is a view of the system of FIG. 2 at the time when the cutting actuating switch is engaged.

With reference now to FIGS. 2 and 3, an appreciation of the method of actuation of the limit switch valve 46 can be obtained. As shown, the base plate 30, driven by the piston rod 28, carries with it an L-shaped switch actuator plate 54 which is positioned immediately above and in alignment with the switch actuator button 56 of the limit switch valve 46. Moreover, the actuator button 56 is positioned at a point sufficiently below the retracted position of the base plate 30 that the actuator plate 54 engages the button 56 and actuates the limit switch valve 46 upon completion of the downward stroke of the piston 28 following actuation of the actuator 24. As a result, at the end of the stroke and operation of needle hook rod 22, the valve 46 is opened, allowing air pressure from the source 32 to pass through the pneumatic actuator 50 to extend a blade to trim the balloon tail as will be discussed below.

Figure 4:
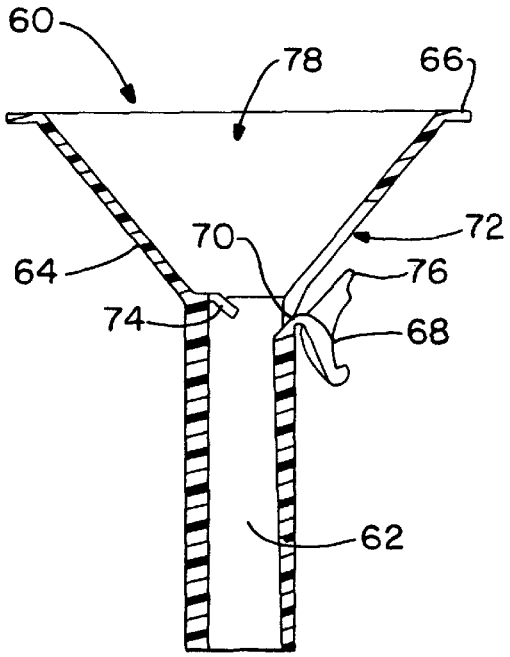
FIG. 4 is cross sectional view of a locking balloon cup in its open position.
Figure 5:
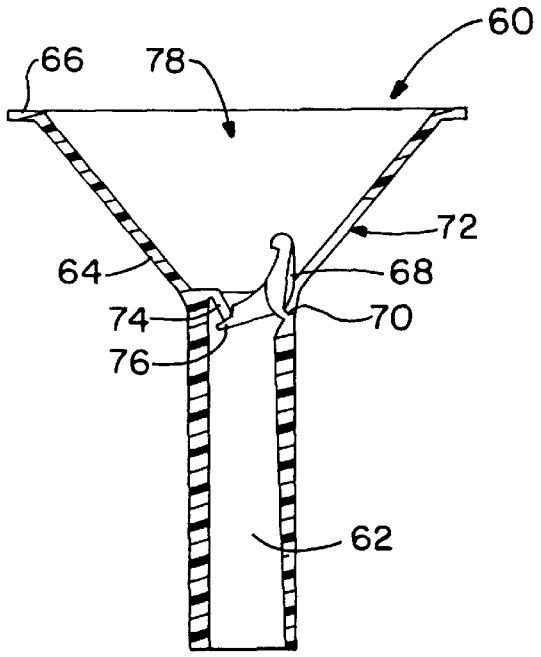
FIG. 5 is a cross sectional view of the locking balloon cup in its locked position.

With reference now to FIGS. 4 and 5, it can be seen that a balloon cup assembly employed to achieve the objects of the invention is designated generally by the numeral 60. As shown, the balloon cup 60 includes a tube 62 interconnected to a funnel-shaped cup 64. A flange rim 66 is defined about the mouth of the funnel 66, as has previously been known in the art.

Near the neck of the balloon cup assembly 60, defined by the interconnection of the tube 62 and funnel 64, a latch 68 is positioned. As shown in its open position in FIG. 4, the latch 68 is hinged as at 70 at a point just beneath the junction of the tube 62 and funnel 64. In other words, the hinged connection is effected at the neck of the balloon cup assembly 60. Those skilled in the art will appreciate that the balloon cup assembly 60 is of molded plastic and, accordingly, the hinge 70 is a thin plastic piece, often referred to as a "living hinge."

As also apparent from FIGS. 4 and 5, a window 72 is presented in the wall of the funnel 64 adjacent the latch 68, allowing the latch 68 to be pivoted through the window 72 and into engagement with a lip 74 which extends from the inner periphery of the tube 62, as shown. The lip 74, which is somewhat rigid in nature, is positioned to latchingly engage with a tab 76 on an end of the latch 68. It will be appreciated that the latch 68 does not sealingly block the tube 62, but provides a locking interference member thereat. Indeed, as will be appreciated later herein, as the neck of a balloon is nestingly drawn into and received by the conical cavity 78, the tail of the balloon, which passes through the tube 62, is drawn through the latch 68 which is deflected beyond its latched position as shown in FIG. 5. However, retraction of the balloon from nesting engagement in the conical cavity 78 is precluded by the latched engagement between the lip 74 and tab 76.

Figure 6:
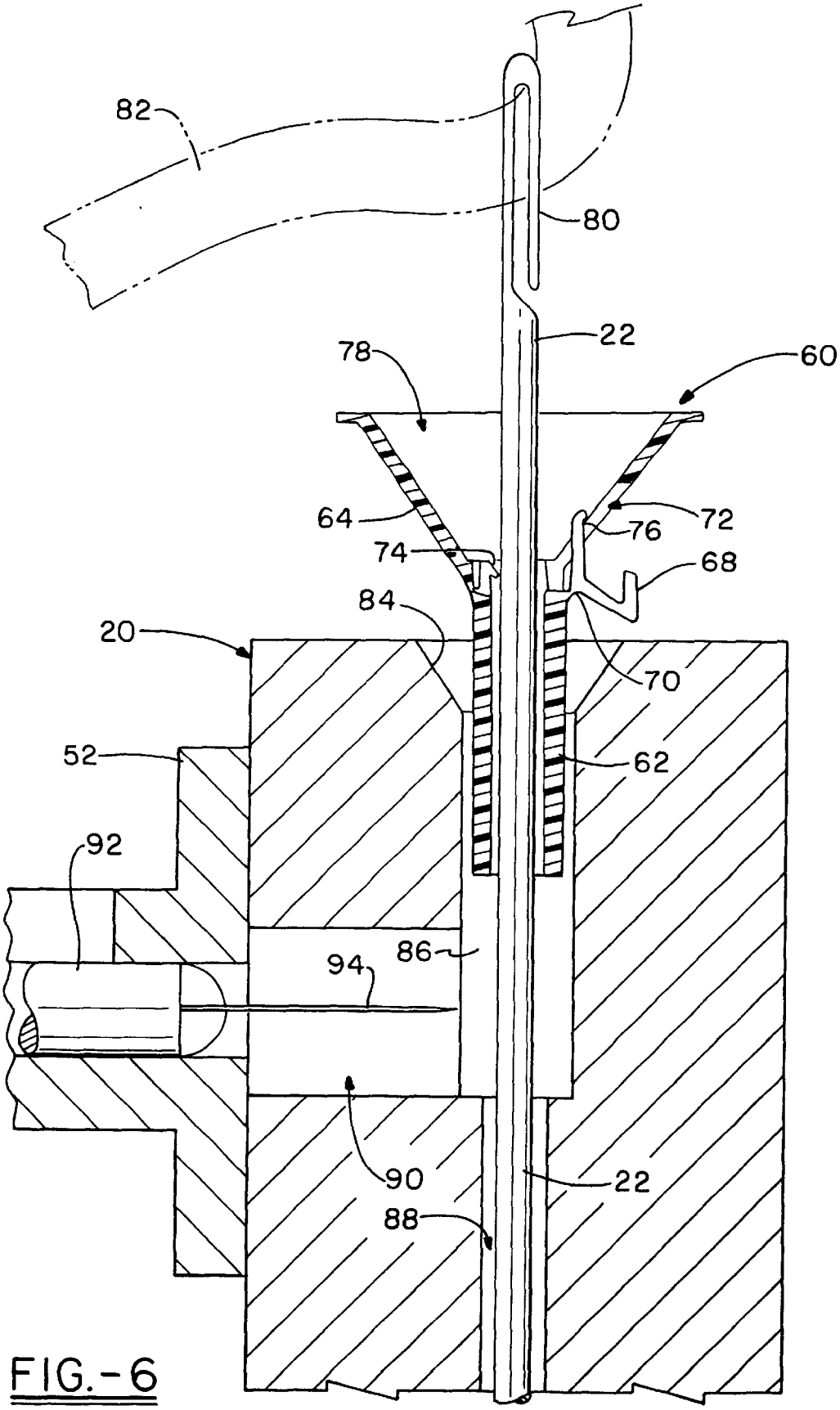
FIG. 6 is a cross sectional view of the balloon cup securing system according to the invention, showing the cup actuation funnel and tail cutter blade prior to seating of the cup.
Figure 7:
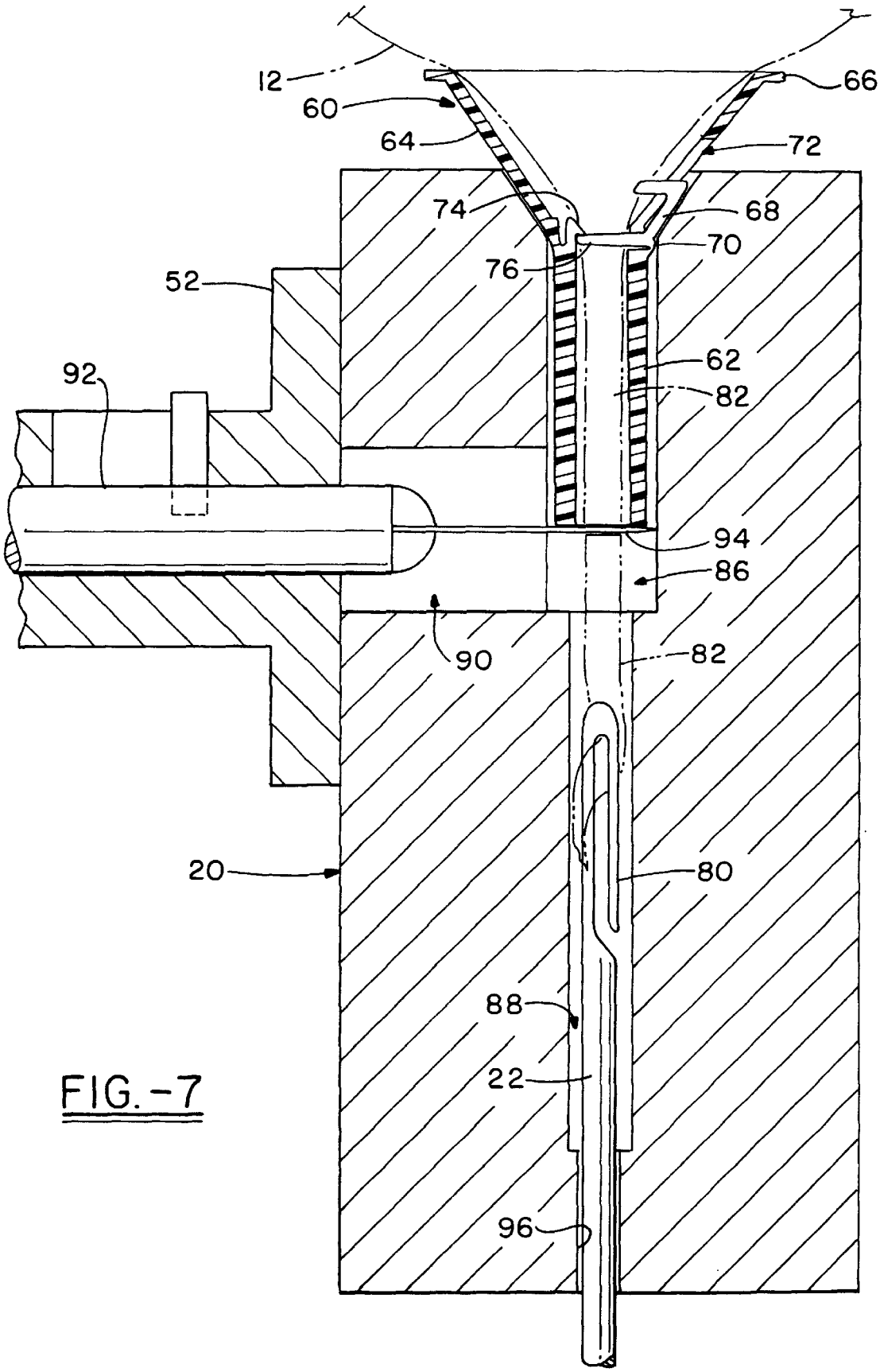
FIG. 7 is a cross sectional view of the balloon cup securing system according to the invention showing the cup seated and the blade actuated.

An appreciation of the implementation and use of the balloon cup assembly 60 in conjunction with the balloon cup securing system 10 can be obtained with reference to FIGS. 6 and 7. As shown, a balloon cup assembly 60 is positioned over the top end of the rod 22 and is maintained atop the housing 20. A hook 80 or other securing structure is positioned at an end of the rod 22 and is adapted for receiving a tail 82 of a sealed balloon 12, as shown. A funnel shaped mouth 84 in a top surface of the housing 20 receives the cup 60 which is maintained upon the rod 22. It is preferred that the funnel shaped mouth 84 is of substantially the same configuration as the funnel 64 of the balloon cup assembly 60. The funnel shaped mouth 84 extends into and is coaxial with a central bore 86 which itself feeds into and is coaxial with a smaller bore 88. As illustrated, the needle rod 22 passes through the mouth 84 and bores 86, 88 and is reciprocatingly received therein.

As also shown in FIGS. 6 and 7, a cross bore 90 extends in the housing 20 orthogonal to the bore 86 near the bottom thereof. The bore 90 receives the piston 92 of the actuator 50 which has connected thereto a blade 94.

With continued reference to FIGS. 6 and 7, it will be appreciated that in use the tail 82 of an inflated and sealed balloon 12 is passed through the hook 80 at the end of the rod 22, following the placement of a cup assembly 60 thereover. The balloon is then positioned upon the platform 12 with the neck end of the balloon abutting the end bracket 16, such that there is provided an appropriate amount of balloon tail 82 for drawing the balloon into engagement with the cup assembly 60 for the desired locking engagement. The operator then actuates the foot pedal valve 36, passing air pressure to the pneumatic cylinder 24, actuating the same. The downward stroke of the piston rod 28 pushes the base plate 30 downward, drawing the needle hook rod 22 with it. Accordingly, the tail 82 is drawn through the funnel 64 and tube 62 of the cup assembly 60 until the neck of the balloon is pulled into the conical cavity 78, at which time the cup 60 is pulled into the funnel shaped mouth 86, with the conical wall of the mouth 84 serving as a cam against latch 68. The latch 68 pivots about the hinge 70 as tab 76 passes by the lip 74. The continued downward stroke of the rod 22 nestingly engages the neck of the balloon 12 within the cup 60 and further deflects the latch 68 beyond the engagement between the lip 74 and tap 76 as required. At the end of the downward stroke of the piston rod 28, the balloon is tightly and nestingly secured in the cup 60 and tail 82 is drawn down in the bore 86. At the bottom of this stroke, the button 56 of the limit switch valve 46 is actuated by the base plate 30, causing air pressure to pass from the conduit 44 through the conduit 48 and to the pneumatic actuator 50, causing the piston 92 and connected blade 94 to be drawn into the bore 90, severing the tail 82. The balloon 12 and cup assembly 60 are thus maintained as an integral unit, locked by the latch 68 at the point of interengagement between the lip 74 and tab 76.

The length of the stroke of the piston 20 and the positioning of the balloon 12 with respect to the end bracket 16 upon the platform 14 is preferable such that there is a slight tension in the balloon tail 82 when it is severed. The tension has been found to preferably be such that the resultant balloon and cup assembly actually pops from the funnel mouth 84 upon such severing. Upon removal of the operator's foot from the foot pedal 36, air is released from the pneumatic cylinders 24, 50, with blade 94 retracting from its interference position within the bore 86, and with the needle hook rod 22 returning to its static position with the hook 80 extending above the top of the housing 20. The remnant of the tail 82 may then be removed such that the process can be repeated. Further, the balloon 12 and attached cup assembly 60 may then be attached to the end of an appropriate balloon stick which is received within the tube 62.

As shown in FIG. 7, in a preferred embodiment of the invention, the coaxial bores receiving the rod 22 may be three tiered, a first larger bore 86 being adapted for receiving the tube 62, a second intermediate bore 88 being sufficiently large to receive the hook 80 and tail remnant 82, and a final bore 96 being sufficient for receiving and closely guiding the rod 22.

Thus it can be seen that the objects of the invention have been satisfied by the structures and process presented above. While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. A balloon cup assembly for receiving and supporting a balloon, comprising:

a tube;

a funnel received at a first end of said tube, said funnel and said tube defining a continuous passage; and a latch positioned for selective interposition within said passage, wherein said tube, funnel and latch form one integral unit.

2. The balloon cup assembly according to claim 1, wherein said latch has a tab and said passage has a lip protruding thereinto, said latch being closed upon interengagement of said tab and lip.

3. The balloon cup assembly according to claim 2, wherein said funnel has a window therein, said latch being pivotal through said window.

4. The balloon cup assembly according to claim 3, wherein said latch is hingedly connected to said tube at said first end thereof.

5. A balloon cup assembly for receiving and supporting a balloon comprising:

a tube;

a funnel received at a first end of said tube, said funnel and said tube defining a continuous passage;

a window in said funnel; and a latch positioned for selective interposition within said passage, said latch being pivotal through said window.

6. The balloon cup assembly according to claim 5, wherein said latch is hingedly connected to said tube at said first end thereof.

* * * * *